US007207420B2

(12) United States Patent
Ach

(10) Patent No.: US 7,207,420 B2
(45) Date of Patent: Apr. 24, 2007

(54) INSTALLATION WITH SUPPORT MEANS FOR DRIVING AN ELEVATOR CAR, AND CORRESPONDING SUPPORT MEANS

(75) Inventor: Ernst Ach, Ebikon (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 11/459,386

(22) Filed: Jul. 24, 2006

(65) Prior Publication Data

US 2007/0034452 A1 Feb. 15, 2007

(30) Foreign Application Priority Data

Jul. 25, 2005 (EP) ..... 05106804

(51) Int. Cl.
*B66B 11/04* (2006.01)

(52) U.S. Cl. ..... 187/251; 187/252; 187/254; 187/414; 474/260; 474/266

(58) Field of Classification Search ..... 187/361, 187/351, 251, 252, 254; 474/260, 266
See application file for complete search history.

(56) References Cited

U.S. PATENT DOCUMENTS 2,855,072 A * 10/1958 Drummond ..... 187/241
4,892,510 A * 1/1990 Matsuoka et al. ..... 474/252
7,137,918 B2 * 11/2006 Nonnast et al. ..... 474/260

* cited by examiner

*Primary Examiner*—Gene O. Crawford
*Assistant Examiner*—Terrell Matthews
(74) *Attorney, Agent, or Firm*—Butzel Long

(57) ABSTRACT

An elevator installation has a support device engaging a driven drive pulley for driving an elevator car. The support device loops around the drive pulley at least partly and has a safety section which is so arranged that the safety section interacts with the drive pulley when the elevator car or a counterweight after overrunning an upper position approaches an upper shaft end. The safety section is formed in such a manner that a slipping through results due to the interaction between the drive pulley and the support device.

13 Claims, 5 Drawing Sheets

INSTALLATION WITH SUPPORT MEANS FOR DRIVING AN ELEVATOR CAR, AND CORRESPONDING SUPPORT MEANS

BACKGROUND OF THE INVENTION

The present invention relates to an elevator installation with means for driving an elevator car and a corresponding support means. The present invention additionally relates to a method for providing overrun protection in an elevator installation.

Elevator installations comprise support means so as to be able to support and set in motion an elevator car. For this purpose the support means typically runs around a drive pulley driven by a drive. In most cases at least one counterweight is provided and the elevator car and the counterweight move in opposite sense as soon as the drive sets the drive pulley in motion. The traction between the drive pulley and the support means is designed so that even when the elevator car is loaded the rotation of the drive pulley is converted, as free of slip as possible, into a movement of the support means.

With present day elevator installations the elevator cars are lighter than in the case of conventional installations. The risk therefore exists that in the event of failure of the drive control the drive pulley is driven on and an empty, or almost empty, elevator car is also then conveyed in the direction of an upper shaft end when the counterweight has already moved against a buffer and no longer contributes to moving the elevator car. A spacing between the elevator car and the shaft end therefore always has to be ensured, since this spacing defines a protective space which, for example, protects assembly personnel against being caught. Penetration of the elevator car into this protective space has to be prevented. This problem is amplified due to the fact that modern support means are provided with casings or surface profiles which, due to the high coefficients of friction, enable a high level of traction.

SUMMARY OF THE INVENTION

It is therefore the object of the present invention to offer a reliable solution for use in an elevator installation which makes it possible to prevent drawing up the empty or almost empty elevator car (termed overrunning) in the case of failure of the drive control, faulty operation or other faults in the elevator installation. Moreover, the present invention shall also be usable for preventing overrun of the counterweight in an elevator shaft.

The elevator installation has a support device or means engaging a driven drive pulley for driving an elevator car. The support device loops around the drive pulley at least partly and has a safety section which is so arranged that the safety section interacts with the drive pulley when the elevator car or a counterweight after overrunning an upper position approaches an upper shaft end. The safety section is formed in such a manner that a slipping through results due to the interaction between the drive pulley and the support device.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1A:
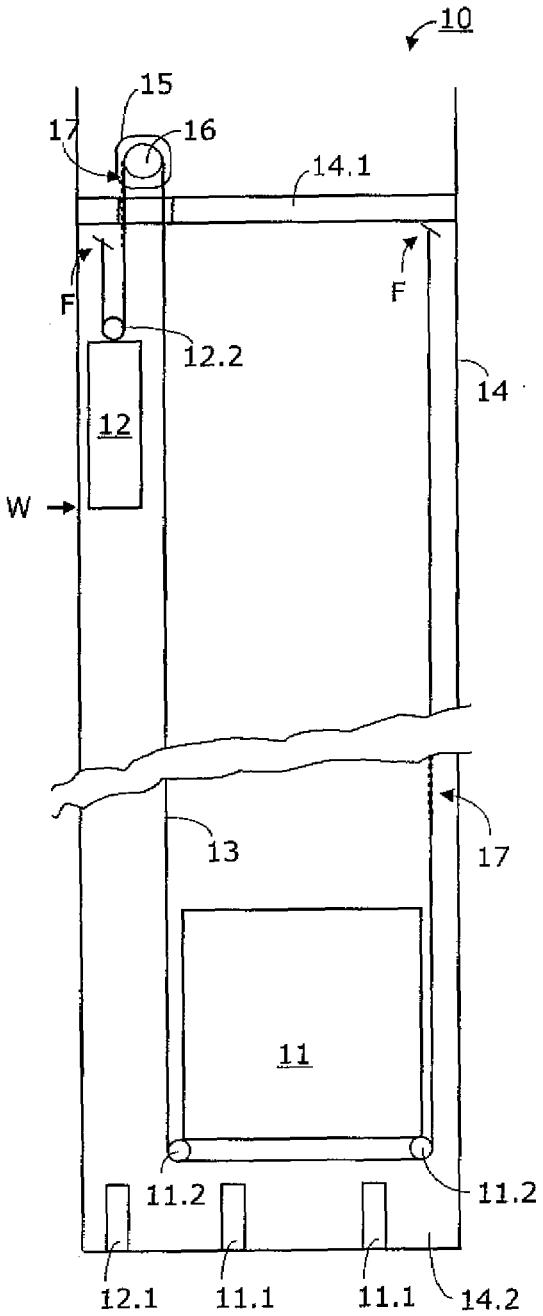
FIG. 1A is a schematic sectional view of an elevator installation according to the present invention wherein an elevator car is disposed in a lower end position in the elevator shaft.

Components which are the same and have similar or same effect are provided in all figures with the same reference numerals.

Figure 1B:
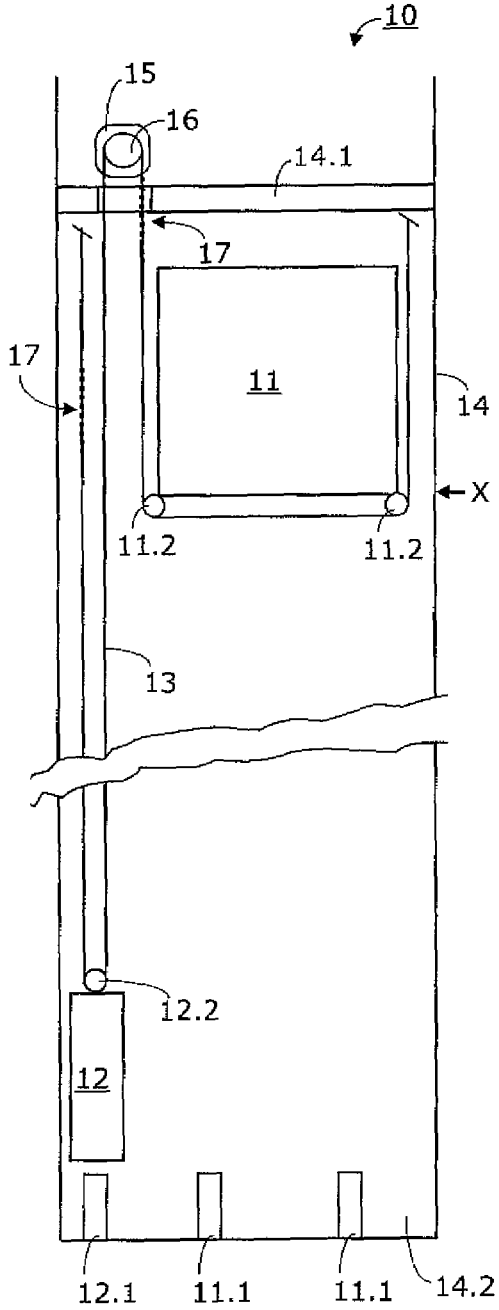
FIG. 1B is a view similar to FIG. 1 with the elevator car disposed in an upper end position in the elevator shaft.
Figure 1C:
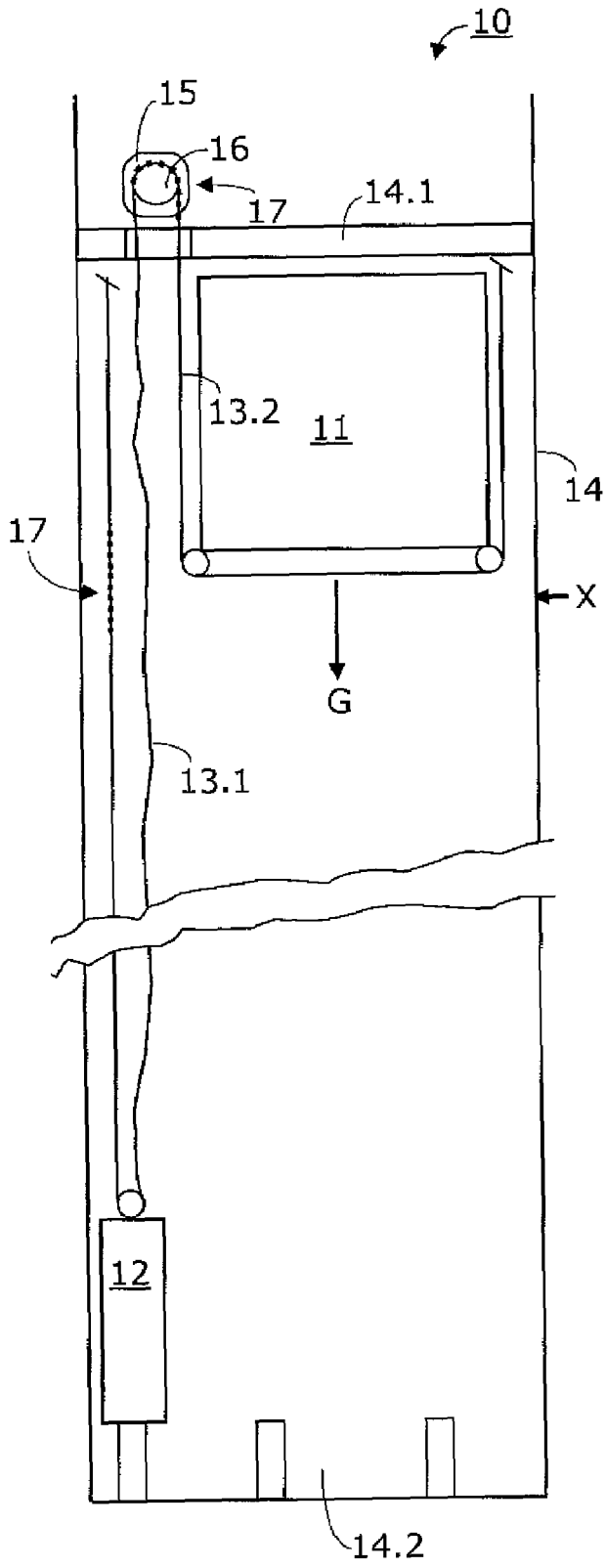
FIG. 1C is a view similar to FIG. 2 wherein the elevator car is shown in an overrun situation.

A first embodiment of the present invention is illustrated in FIGS. 1A to 1C. The example, shown in FIGS. 1A to 1C, is a conventional elevator installation 10 comprising an elevator car 11 which is looped underneath, supported and moved by a support device or means 13. The support means 13 has an elongated body and is so arranged that it is fastened at the two free ends in or at the elevator shaft 14. These fastening points are denoted by F. The support means 13 runs downwardly along the elevator shaft 14 from a first one of the fastening points F on the right side of the shaft. It then loops under the elevator car 11, which has rollers 11.2. On the other side of the elevator car 11 the support means 13 runs upwardly and loops around a drive pulley 16, which, for example, can be driven by a motor 15. Leading from the drive pulley 16, the support means 13 again runs downwardly, loops around a counterweight roller 12.2 at which the counterweight 12 hangs, and extends from there to the second one of the fixing points F.

In the illustrated example, a shaft ceiling 14.1 or a form of bridge or beam, which can carry parts of a drive, is arranged at the upper shaft end. The region over which the elevator car 11 can move is thereby upwardly limited, wherein in the elevator shaft 14 an uppermost position (denoted by X in FIGS. 1B and 1C) is defined which may not be overrun. The present invention is obviously not restricted to elevators with an engine room, but is equally usable for elevators without engine rooms. In addition, buffers 11.1 for the elevator car 11 and buffers 12.1 for the counterweight 12 are provided.

In FIGS. 1A to 1C it is indicated that the support means 13 includes a safety section 17 which is so arranged that the safety section 17 comes into interaction with the drive pulley 16 when the elevator car 11, after overrunning the upper position X, approaches the upper shaft end 14.1 or if the counterweight 12, after overrunning an upper position W, approaches the upper shaft end 14.1. According to the present invention, the safety section 17 is so constructed that a slipping through results due to interaction between the drive pulley 16 and the support means 13. Travel of the car 11 into the uppermost region of the shaft is thereby made impossible. The following descriptions essentially refer to overrunning of the elevator car 11. In terms of meaning there is understood, without being specially mentioned, also overrunning of the counterweight 12 in a reverse direction.

Slipping through describes a state in which the drive pulley 16 rotates without the support means 13 resting on the drive pulley 16 making a substantial movement. A friction force present between the drive pulley 16 and the support means 13 or the safety section 17 is not sufficient to move the support means 13. This state of slipping through can also be termed high slip.

By slip there is denoted the behavior of a technical element—in this case the support belt 13—which should actually be moved in synchronism with another element—in this case the drive pulley 16- and in the case of which, however, the movement departs from this synchronous relationship. In that case the driven element usually always "limps" or "lags" somewhat "behind" the driving element. In normal operation of an elevator installation this slip is very low.

The function of the overrun protection is now explained in more detail by reference to FIG. 1C, which by contrast to the two "normal states" shown in FIGS. 1A and 1B shows the moment of overrunning the upper position X.

In FIG. 1C there is schematic indication of the moment when, in the case of an elevator installation 10 according to the present invention, the elevator car 11 overruns the upper position X. This can occur, for example, because the drive is defective and does not stop in the usual manner when the elevator car 11 has reached the uppermost floor. If the drive 15 runs on, then the drive pulley 16 draws the support means 13 and thus also the elevator car 11 further upwardly.

According to the present invention the support means 13 has the safety section 17 which is so arranged that this safety section 17 interacts with the drive pulley 16 when the elevator car 11 approaches the upper shaft end (for example, 14.1). In FIG. 1C there is shown a state in which the safety section 17 of the support means has already run onto the drive pulley 16. Since the safety section 17 is intentionally constructed so that a higher degree of slip between the drive pulley 16 and the support means 13 results, the drive is no longer in a position of conveying the elevator car 11 further upwardly.

In that case the safety section 17 is constructed so that slipping through occurs under the following preconditions:

(1) The counterweight 12 no longer pulls on a support means run 13.1 after the elevator car 11 has overrun the uppermost position X, since the counterweight 12 sits on the counterweight buffer 12.1. In FIG. 1C it is indicated that tension is no longer on the ran 13.1 from settling of the counterweight 12 on the buffer 12.1.

(2) The elevator car 11 exerts a certain minimum total weight producing a downwardly directed counter-force G at the support means run 13.2.

This means that the safety section 17 has to be constructed so that even in the case of an empty elevator car 11 or an only lightly loaded elevator car 11 a strongly pronounced degree of slippage sets in as soon as the safety section 17 comes into interaction with the drive pulley 16. Since at this point in time the counterweight 12 is seated on the counterweight buffer 12.1 and consequently merely the mass of the support means run 13.1, which is at the counterweight side, acts from the counterweight side on the drive pulley 16 a maximum permissible coefficient of friction between the safety section 17 and the drive pulley 16 is derived from the ratio of the weight of the empty elevator car 11 to the weight of the support means run 13.1 at the counterweight side. Obviously in that case the respective mode of suspension, a looping angle, etc., have to be taken into consideration. The safety section 17 is correspondingly constructed.

Figure 2:
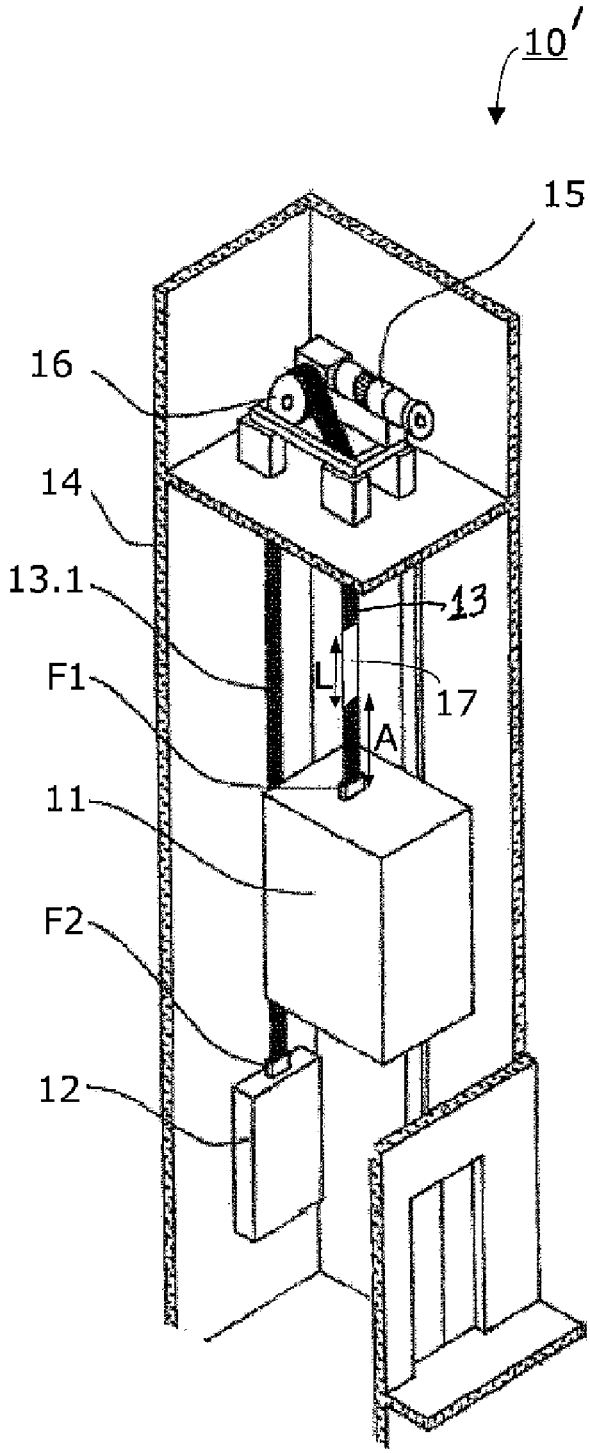
FIG. 2 is a schematic perspective view of an elevator installation according to the present invention.

Another elevator installation 10' according to the present invention is shown in FIG. 2. In this case the support means 13 is connected at one end F1 with the elevator car 11 and at the other end F2 with the counterweight 12. The elevator installation 10' thus does not have underslinging of the elevator car 11. The support means 13 according to the present invention can also be used in this form of configuration. The safety section 17 is, as shown, provided at least one point of the support means 13 located at a spacing A in front of the end F1 of the support means. The spacing A is dependent on the specifications of the elevator installation. The available shaft head height, the arrangement and construction of the drive or the travel speed as well as further data conclusively determine this spacing A. A second safety section (not shown) can be constructed at a comparable spacing from the end F2 of the support means, as indicated in FIGS. 1A to 1C by the second safety section 17 adjacent to the fixing point F at the left of the shaft. Overrunning of the counterweight 12 in the shaft head is thus reliably prevented when the elevator car 11 is seated on the buffers 11.1 at the car side.

In a particularly preferred embodiment of the present invention the safety section 17 has a length L (parallel to a longitudinal axis Y of the support means 13 corresponding with at least 3.14 times the value of a radius "R" of the drive pulley 16. These figures, however apply only in the case of elevator installations in which the support means 13 loops around the drive pulley by 180°. The determination of the length L of the safety section 17 is carried out with consideration of the drive pulley radius "R", a looping angle of the drive pulley, a permissible overrun travel, a buffer stroke and the consideration of dynamic stopping paths as well as a safety margin. The length L of the safety section 17 is so designed in every case that the support means cannot sway back and forth as a consequence of dynamic processes between the safety section 17 and the remaining support means region. In a concrete example, the length of the safety section 17 is 200 millimeters for a drive pulley radius "R" of 35 millimeters.

Figure 3:
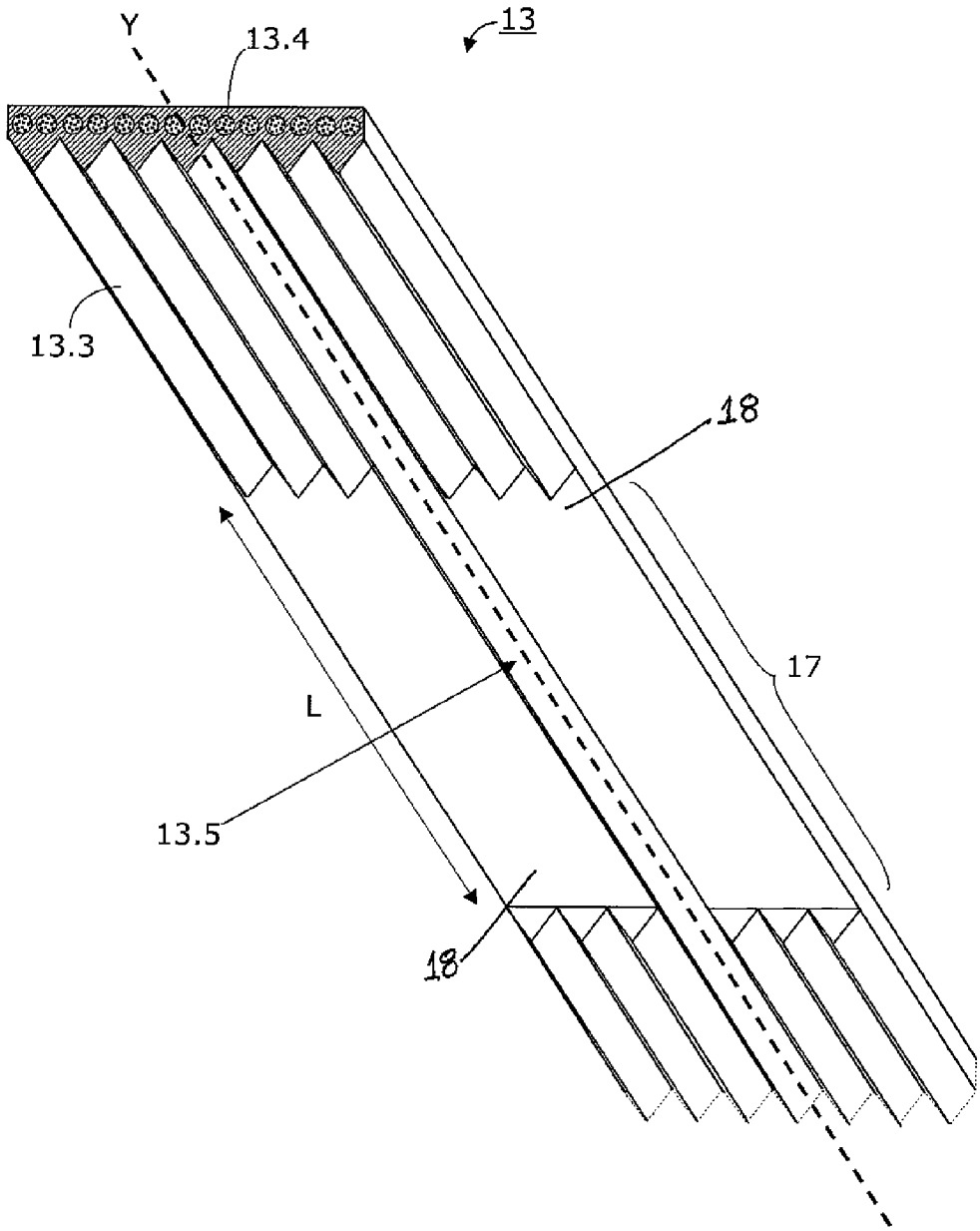
FIG. 3 is a schematic perspective view of a section of a first belt-like support means according to the present invention.

The present invention can use not only the belt-like support means 13, as shown in FIG. 3, but also a cable-like support means, for example unsheathed steel cables, or the like.

If the belt-like support means 13 are used, then these usually have longitudinal or transverse ribs as a surface structure on one side. The belt-like support means 13 shown in FIG. 3 has a poly-V-structure with several longitudinal ribs 13.3 extending parallel to the longitudinal axis Y of the support means 13. In a preferred embodiment the longitudinal or transverse ribs are of different construction, or entirely absent, in the region of the safety section 17. FIG. 3 shows an embodiment in which one of the longitudinal ribs 13.5 extends over the entire length of the support means 13 (inclusive of the length L of the safety section 17). The other longitudinal ribs have an interruption in the region of the safety section 17. Through such a form of the support means 13 it is ensured on the one hand that even when the safety section 17 of the support means 13 interacts with the drive pulley 16 a sufficient lateral guidance is guaranteed by the longitudinal rib 13.5, whilst on the other hand an "intended slipping" of the support means due to deliberately provoked slippage comes about since the traction between the drive pulley 16 and the safety section 17 is less than between another section of the support means 13 and the drive pulley 16.

Figure 4:
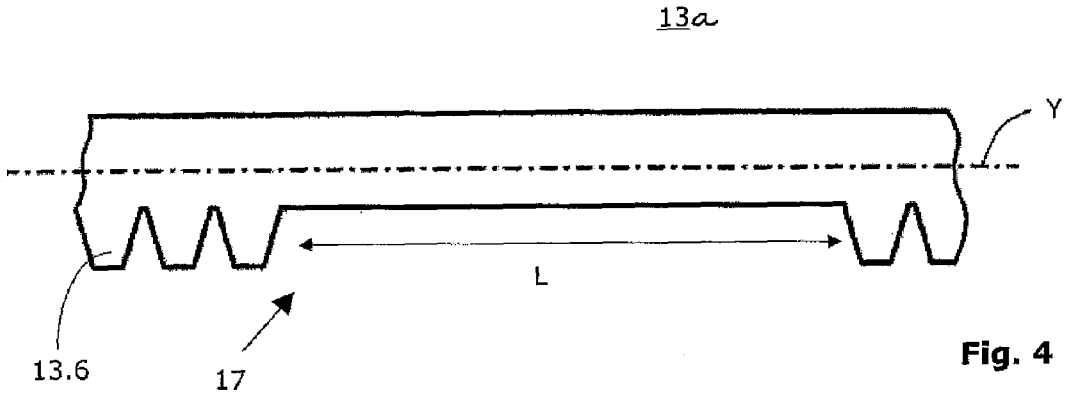
FIG. 4 is a schematic side view of a section of a second belt-like support means according to the present invention.

A further belt-like support means 13*a* according to the present invention is shown in FIG. 4. The illustrated support means 13*a* is a form of an elongated body cogged belt with a plurality of teeth 13.6 extending perpendicularly to the longitudinal direction Y of the support means 13*a*. In the region of the safety section 17 having the length L the surface structure of the support means 13*a* is changed so as to reduce the traction between the drive pulley 16 and the support means 13*a* when the safety section 17 runs onto the drive pulley 16. In the illustrated example, the teeth 13.6 of the cogged belt were reduced in their tooth height or approximately removed.

In another embodiment of the belt-like support means 13, a traction-reducing coating 18 (FIG. 3) is applied in the region of the safety section 17. By this means, as well, the traction can be selectively reduced so as to trigger slipping-through in the case of overrunning.

The belt-like support means 13, 13*a* are particularly preferred in which not only the surface structure in the region of the safety section 17, but also the surface properties were changed (for example by application of the traction-reducing coating 18, such as, for example, a slide means).

There can thus be applied, for example by a spray, a slide means which has good adhesion to the support means 13 and which changes the surface property in the safety section 17. Advantageously, the adjoining regions of the support means 13 are covered beforehand by means of protective tape or template. The protective tape or the template can be removed again after a certain drying time of the adhering slide means.

This method is particularly advantageous, since after assembly of the elevator installation the installation can be measured or investigated in order to be able to then establish the position of the safety section 17 at the support means 13. Then, as described, the safety section can be "produced" in situ and be tested after drying of the slide means.

If cable-like support means 13 are used, then the support means 13 comprising a traction-reducing coating in the region of the safety section 17 are particularly suitable.

According to the present invention, the support means 13, 13*a* constructed especially for use in the elevator installation 10, 10' are also provided. The above-mentioned factors (weight of the elevator car 11, looping around of the drive pulley 16, property of the drive pulley 16, etc.) must be taken into consideration in the design of the support means 13, 13*a*. In order to ensure the safety action in the case of overrunning, the support means 13, 13*a* according to the present invention must comprise the safety section 17 and have in the region of the safety section 17 a surface structure and/or surface property different than in other length sections of the support means.

The length L of the safety section 17 preferably extends parallel to the longitudinal axis Y of the support means 13, 13*a*. The ratio between the length L and the overall length of the support means 13 is dependent on the conveying height, the form of elevator suspension and the drive pulley radius "R". Thus, for example, in the case of a conveying height of 20 meters, the support means 13 is approximately 50 meters long when the car is underslung (see FIG. 2). In the case of a drive pulley radius of 35 millimeters, a length L of the safety section 17 of preferably approximately 200 millimeters results. The length ratio between the safety section 17 and the overall length of the support means 13, 13*a* thus is, in this example, 0.2/50=0.4%.

With all these considerations, however, it must be taken into account that the load-bearing capability of the support means 13, 13*a* must not be put at risk by the application or provision of the safety section 17. For this purpose, a belt-like support means 13, 13*a* can be equipped with, for example, steel cables 13.4 or steel strands, as shown in FIG. 3.

The present invention thereby makes possible that the section of the support means where the safety section 17 is provided interacts with the drive pulley only in an emergency situation, namely on overrunning of the upper position X. In normal operation the safety section 17 never runs onto the drive pulley 16.

The elevator installation is preferably designed so that the drive is switched off by a running time control and/or a slipping-through control and/or a torque monitoring or other safety circuits as soon as the interaction between the safety section 17 and the drive pulley 16 occurs. The torque monitoring detects, for example, when as a consequence of a sudden change in torque—because the drive capability suddenly changes—the motor current rapidly changes and shuts down the drive. Through these supplementary measures, but also particularly through the arrangement of the safety section 17 according to the present invention, the elevator installation is protected against further damage such as, for example, excessive heating of the drive and the support means. If, for example, there is slipping through of the drive pulley 16 in the case of an elevator installation without the safety section 17 there results in short time a strong heating up of the support means region concerned, which in certain circumstances can lead to melting of a casing of the support means, in the contact region of support means with respect to the drive pulley. The construction of the safety region 17 with the illustrated traction-reducing measures significantly reduces the friction work and thus the heat loading.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation including an elevator shaft and an elevator car and a counterweight positioned in the shaft comprising:

a support means supporting the elevator car and the counterweight and including at least one safety section; and a drive pulley for driving said support means wherein said support means has at least one of a plurality of longitudinal ribs and transverse ribs formed at a surface facing said drive pulley and, wherein said support means at least partly loops around the drive pulley and said at least one safety section wherein a region of said at least one safety section said ribs are of different construction than other sections of said support means or are entirely absent produces a slipping through by interaction between said drive pulley and said at least one safety section.

2. The elevator installation according to claim 1 wherein said support means has in a region of said at least one safety section a surface structure and/or surface property different than in other sections of said support means.

3. The elevator installation according to claim 1 wherein said at least one safety section has parallel to a longitudinal axis of said support means a predetermined length corresponding with at least 3.14 times a radius of said drive pulley.

4. The elevator installation according to claim 1 wherein said support means is formed as a cable.

5. The elevator installation according to claim 1 wherein said support means is formed as an elongated belt.

6. The elevator installation according to claim 1 wherein said support means has a traction-reducing coating applied in a region of said at least one safety section.

7. The elevator installation according to claim 1 wherein said at least one safety section interacts with said drive pulley when the elevator car after overrunning a first upper position in the shaft or the counterweight after overrunning a second upper position in the shaft approaches an upper end of the shaft.

8. A support means for use in an elevator installation in which the support means at least partly loops around a driven drive pulley and the drive pulley drives the support means, comprising:

an elongated body including at least one safety section which by interaction between the drive pulley and said at least one safety section causes a slipping through; and wherein said elongated body is formed as a belt having longitudinal or transverse ribs on a surface facing the driven pulley, wherein said ribs are of a different construction in a region adjacent said at least one safety section or are entirely absent in said at least one safety section.

9. The support means according to claim 8 wherein said support means body is formed as a belt having a traction-reducing coating applied to a surface of said at least one safety section.

10. The support means according to claim 8 wherein said support means body is formed as a cable having a traction-reducing coating applied to a surface of said at least one safety section.

11. A method of providing overrun protection in an elevator installation with a support means and a driven drive pulley for driving the support means, wherein the support means at least partly loops around the drive pulley, comprising the steps of:

a. forming a safety section at a surface of the support means wherein said support means has at least one of a plurality of longitudinal ribs and transverse ribs formed at a surface facing said drive pulley, wherein a region of said at least one safety section said ribs are of different construction than other sections of said support means or are entirely absent;

b. covering a part of the support means with a protective tape or a template, wherein the covered part adjoins the safety section;

c. applying a slide means which adheres to the support means surface in the safety section; and d. removing the protective tape or the template.

12. The method according to claim 11 wherein said step c. is performed by spraying the slide means on the support means surface.

13. The method according to claim 11 wherein said step a. is performed by forming the safety section at a position to interact with the drive pulley when an elevator car supported by the support means after overrunning a first upper position or a counterweight supported by the support means after overrunning a second upper position approaches an upper shaft end of the elevator installation, wherein a slipping through results in the region of the safety section through an interaction between the drive pulley and the safety section.

* * * * *